US007470165B2

(12) United States Patent
Ivanic et al.

(10) Patent No.: US 7,470,165 B2
(45) Date of Patent: Dec. 30, 2008

(54) BUBBLE MAKER

(75) Inventors: Robert J. Ivanic, Saugus, CA (US); Joseph Wong Wai Ching, Tai Po (HK); Siu Tsz Ming, Tai Po (HK)

(73) Assignee: Imperial Toy, LLC, Los Angeles, CA (US)

( * ) Notice: Subject to any disclaimer, the term of this patent is extended or adjusted under 35 U.S.C. 154(b) by 127 days.

(21) Appl. No.: 11/473,942

(22) Filed: Jun. 23, 2006

(65) Prior Publication Data

US 2007/0298674 A1 Dec. 27, 2007

(51) Int. Cl.
*A63H 33/28* (2006.01)
*A63H 33/00* (2006.01)

(52) U.S. Cl. ..... 446/15

(58) Field of Classification Search ..... 446/15–21
See application file for complete search history.

(56) References Cited

U.S. PATENT DOCUMENTS

| | | | | |
|---|---|---|---|---|
| D39,141 | S | 2/1908 | Kopel | |
| D138,560 | S | 8/1944 | Morehead | |
| D166,995 | S | 6/1952 | Rachins | |
| 3,228,136 | A | 1/1966 | Rouse | |
| D277,198 | S | 1/1985 | Paczko | |
| D288,457 | S | 2/1987 | Perez | |
| 4,995,844 | A | 2/1991 | McNett et al. | |
| 5,114,376 | A | 5/1992 | Copley et al. | |
| D333,722 | S | 3/1993 | Ricciardi | |
| 5,207,728 | A | 5/1993 | Fogarty et al. | |
| 5,360,362 | A | 11/1994 | Cernansky et al. | |
| 5,386,909 | A | 2/1995 | Spector | |
| D366,075 | S | 1/1996 | Bhandhugravi et al. | |
| 5,498,191 | A | 3/1996 | DeMars | |
| 5,613,890 | A * | 3/1997 | DeMars | 446/15 |
| D384,114 | S | 9/1997 | Spielberg | |
| 5,695,379 | A * | 12/1997 | Ho | 446/15 |

(Continued)

FOREIGN PATENT DOCUMENTS

DE 20100944 U1 4/2001

(Continued)

OTHER PUBLICATIONS

"PCT International Search Report and Written Opinion," dated Apr. 13, 2007, Imperial Toy, Inc., PCT/US2006/043709, filed Nov. 8, 2006.

*Primary Examiner*—Kien T Nguyen
(74) *Attorney, Agent, or Firm*—Blakely, Sokoloff, Taylor & Zafman LLP

(57) ABSTRACT

A device includes a main body portion connected to a front body portion. The main body portion has a handle with a trigger. The front body portion has a through hole. A movable mouth portion is connected to the main body portion. The movable mouth portion includes a fixed wipe bar. A reservoir is located between the main body portion and the front body portion. The reservoir includes a clear front portion. The reservoir to hold liquid. A motorized bubble making unit is located between the main body portion and the front body portion. When the trigger is pulled the movable mouth portion is raised to expose a bubble forming ring and the motorized bubble making unit is activated to expel a stream of bubbles through the bubble forming ring.

20 Claims, 10 Drawing Sheets

U.S. PATENT DOCUMENTS

| | | | | |
|---|---|---|---|---|
| D389,022 | S | 1/1998 | Rausch | |
| D396,315 | S | 7/1998 | Hamerman | |
| 5,888,117 | A | 3/1999 | Sutton | |
| D407,941 | S | 4/1999 | Lewis et al. | |
| D448,514 | S | 9/2001 | Sehl | |
| D453,541 | S | 2/2002 | Steele et al. | |
| 6,350,169 | B1 | 2/2002 | Holt | |
| 6,416,377 | B1 * | 7/2002 | Bart | 446/15 |
| 6,422,974 | B1 * | 7/2002 | Schimmel | 482/44 |
| 6,547,622 | B2 * | 4/2003 | Thai | 446/15 |
| D474,817 | S | 5/2003 | Rogers et al. | |
| 6,620,016 | B1 | 9/2003 | Thai | |
| 6,620,017 | B1 * | 9/2003 | Bitton | 446/16 |
| 6,988,926 | B2 | 1/2006 | Thai | |
| D519,581 | S | 4/2006 | Velez et al. | |
| 7,056,182 | B2 * | 6/2006 | Wan | 446/15 |
| 7,165,289 | B1 | 1/2007 | Gossage | |
| 2003/0228824 | A1 | 12/2003 | Thai | |
| 2006/0084351 | A1 | 4/2006 | Wan | |
| 2006/0292956 | A1 | 12/2006 | Sayles | |
| 2007/0019405 | A1 | 1/2007 | Chang et al. | |
| 2007/0117491 | A1 | 5/2007 | Thai | |
| 2008/0096459 | A1 | 4/2008 | Mingle | |

FOREIGN PATENT DOCUMENTS

| | | |
|---|---|---|
| ES | 2020404 | 8/1991 |
| GB | 2224950 | 5/1990 |

* cited by examiner

BUBBLE MAKER

BACKGROUND

1. Field

The embodiments relate to toys. In particular, the embodiments relates to motorized toys for forming and expelling streams of bubbles.

2. Description of the Related Art

Many bubble forming toys are known. These include toys shaped like pistols and guns. These toys, however, have drawbacks. The drawbacks include wasting excess fluid (i.e., liquid soap fluid) and also how bubbles are formed and expelled from the toy.

SUMMARY

One embodiment is a device that includes a main body portion connected to a front body portion. The main body portion has a handle with a trigger. The front body portion has a through hole. A movable mouth portion is connected to the main body portion. The movable mouth portion includes a fixed wipe bar. A reservoir is located between the main body portion and the front body portion. The reservoir includes a clear front portion. The reservoir to hold liquid. A motorized bubble making unit is located between the main body portion and the front body portion. When the trigger is pulled the movable mouth portion is raised to expose a bubble forming ring and the motorized bubble making unit is activated to expel a stream of bubbles through the bubble forming ring.

Another embodiment includes a bubble making toy. The bubble making toy includes an animal shaped body portion having a handle with a trigger. The body portion has a through hole. A movable mouth portion is coupled to the body portion. A fixed wipe bar is coupled to an interior roof of the movable mouth portion. A reservoir is disposed in the body portion. The reservoir includes a clear front portion viewable through a through-hole in the body portion. The reservoir to hold bubble liquid. A motor is coupled to a blower and a pump that are both disposed within the body portion. The trigger activates the blower and pump to force a stream of bubbles through a bubble forming ring.

Yet another embodiment is a bubble toy including an animal shaped body portion having a handle with a trigger. The body portion has a through hole. A movable mouth portion is connected to the body portion. A fixed wipe bar is connected to a roof of an interior of the movable mouth portion. A belly shaped reservoir is disposed in the main body portion. The reservoir includes a clear front portion viewable through the through-hole in the body portion. The reservoir to hold bubble liquid. A motor is connected to a blower and a pump. The motor, the pump, and the blower are located within the body portion. The trigger activates the motor to force a stream of bubbles formed through a bubble forming ring.

BRIEF DESCRIPTION OF THE DRAWINGS

The embodiments are illustrated by way of example, and not by way of limitation, in the figures of the accompanying drawings and in which like reference numerals refer to similar elements and in which.

DETAILED DESCRIPTION

The embodiments discussed herein generally relate to motorized automatic bubble making toys. Referring to the figures, exemplary embodiments will now be described. The exemplary embodiments are provided to illustrate the embodiments and should not be construed as limiting the scope of the embodiments.

Figure 1:
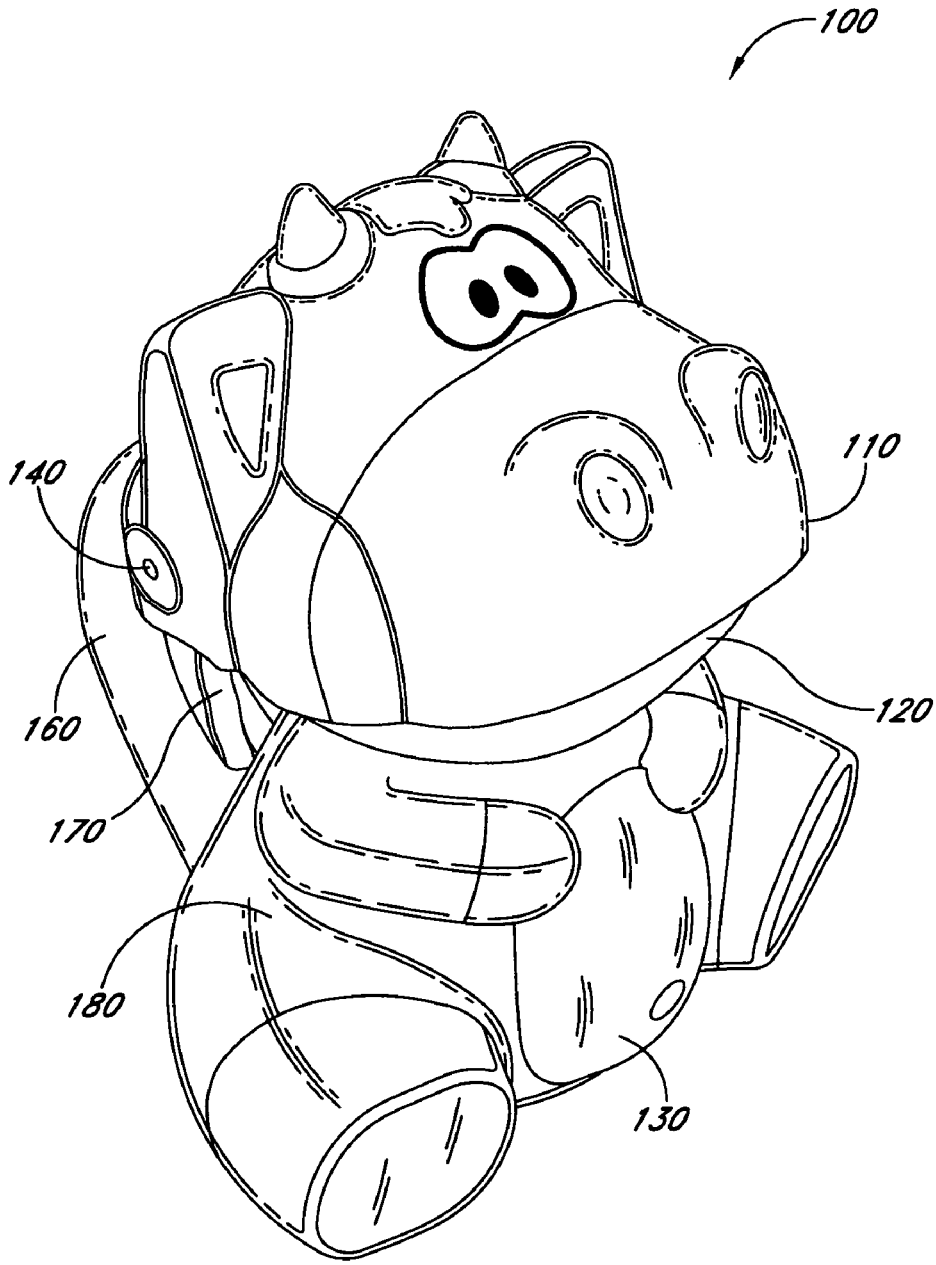
FIG. 1 illustrates a perspective view of an embodiment of a bubble making toy.

FIG. 1 illustrates a perspective view of a bubble making toy. Bubble making toy 100 includes movable mouth portion 110, front body portion 120, main body portion 150, liquid reservoir 130, couplers 140 (left and right), handle 160 and trigger 170. Main body portion 150, front body portion 120, movable mouth portion 110 and reservoir 130 make up the body of bubble making toy 100. The body has a form of an animal, such as a cow, a rhinoceros, a pig, a dog, a cat, etc. Reservoir 130 has a form of a belly (including a belly button). Reservoir 130 has a front portion that is see-through so a user of bubble making toy 100 can see bubble liquid in the reservoir. This helps a user know when reservoir 130 is becoming empty.

Figure 2:
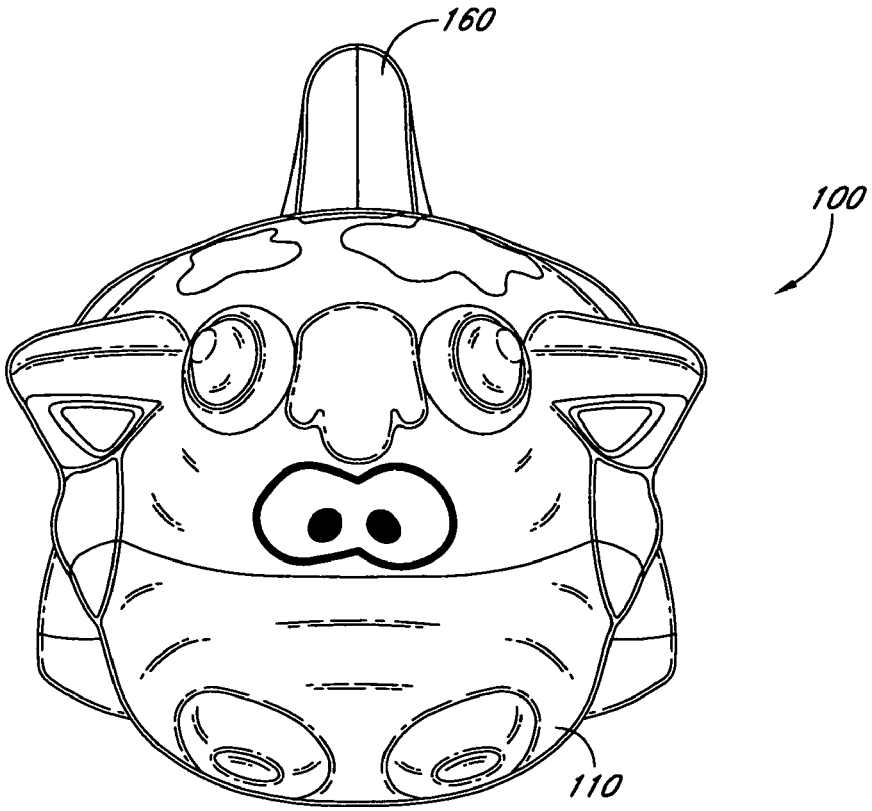
FIG. 2 illustrates a top view of the embodiment illustrated in FIG. 1.
Figure 3:
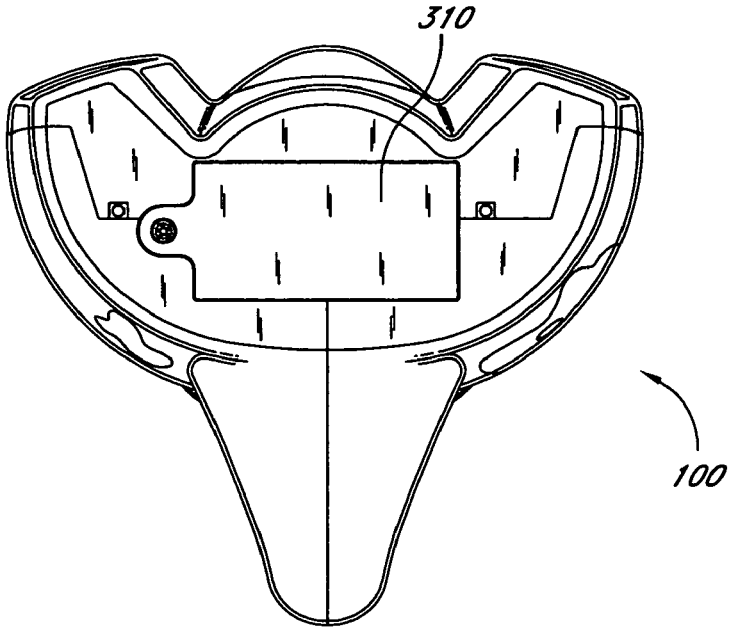
FIG. 3 illustrates a bottom view of the embodiment illustrated in FIG. 1.

FIG. 2 illustrates a top view of the embodiment illustrated in FIG. 1. FIG. 3 illustrates a bottom view of the embodiment illustrated in FIG. 1. Bubble making toy 100 includes battery compartment lid 310. In one embodiment, battery compartment lid 310 is secured with a screw. In another embodiment, battery compartment lid 310 can be secured by other known means, such as friction fitting.

Figure 4:
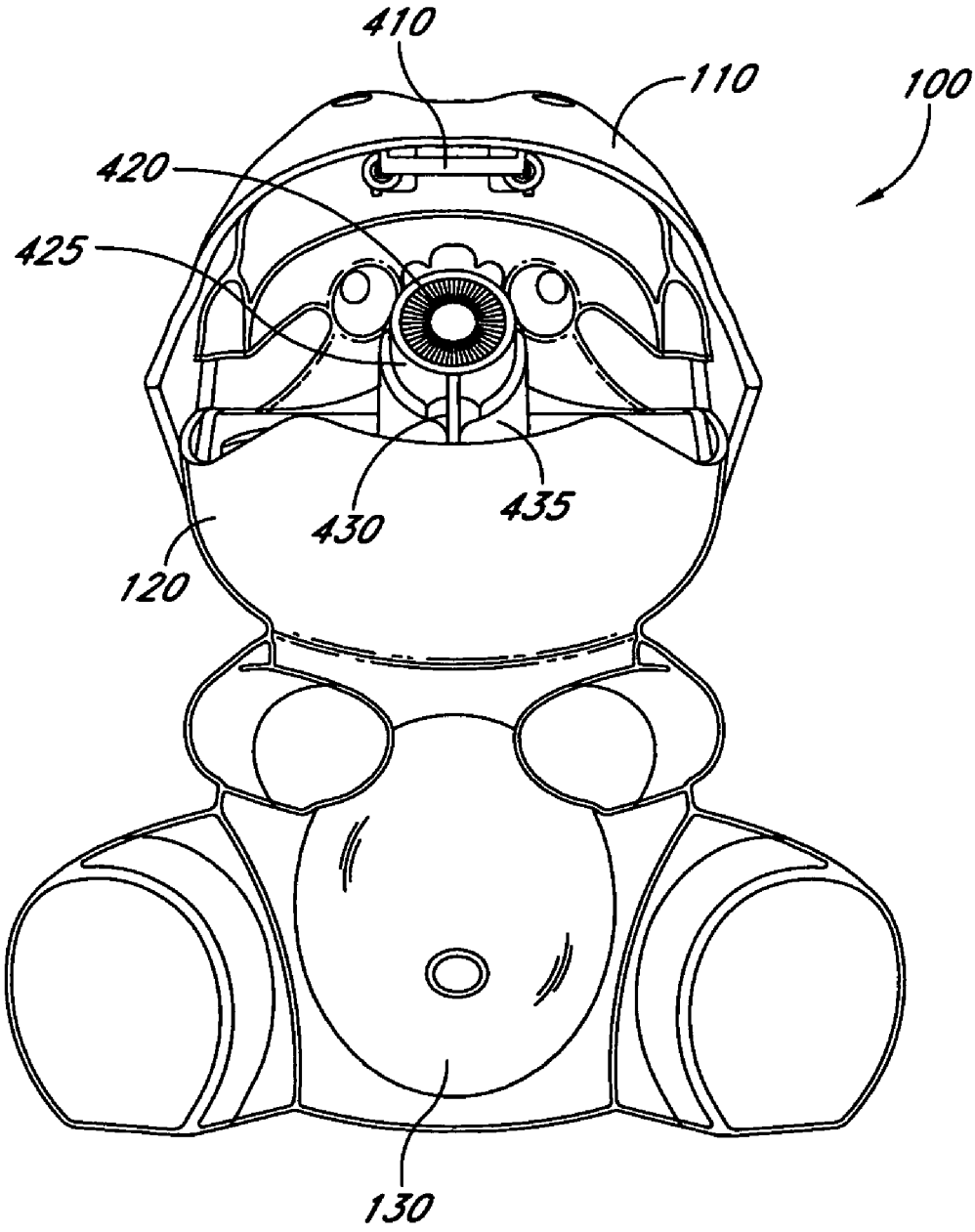
FIG. 4 illustrates a front view of the embodiment illustrated in FIG. 1 with an upper mouth portion raised.

FIG. 4 illustrates a front view of bubble making toy 100 having movable mouth portion 110 in an opened state. In this embodiment, when trigger 170 is pulled, movable mouth portion 110 is raised exposing bubble forming ring 420. Fixed wipe bar 410 is fixed to a roof portion of the interior of movable mouth portion 110. Wipe bar 410 wipes liquid off of bubble forming ring 420. Bubble forming ring 420 is disposed in directional overflow housing 425 that is connected to mixing chamber 435. Directional overflow housing 425 includes lower portion 430 that directs overflow liquid into reservoir 130.

Figure 5:
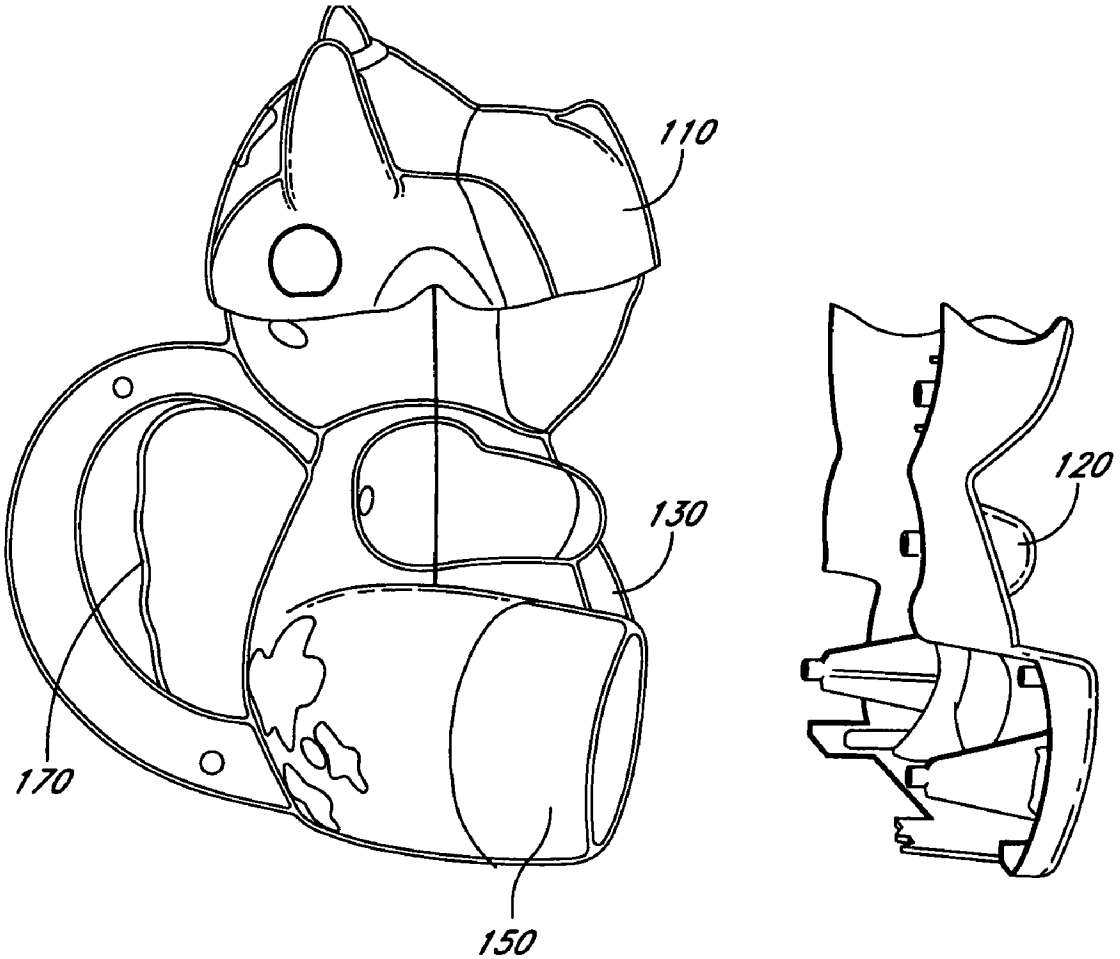
FIG. 5 illustrates a side view of the embodiment illustrated in FIG. 1 with a front body portion separated from the main body portion.

FIG. 5 illustrates a side view of an embodiment with front body portion 120 removed from main body portion 150. In one embodiment, the body portions are made of a hard plastic material. Reservoir 130 has the see-through portion connected to a non-see-through portion. The two portions are sealed together to prevent leakage of liquid. Reservoir 130 has an upper opening to trap overflow liquid, a pouring opening used to add liquid to reservoir 130, and a lower opening to deliver liquid to a pump (see FIG. 8).

Figure 6:
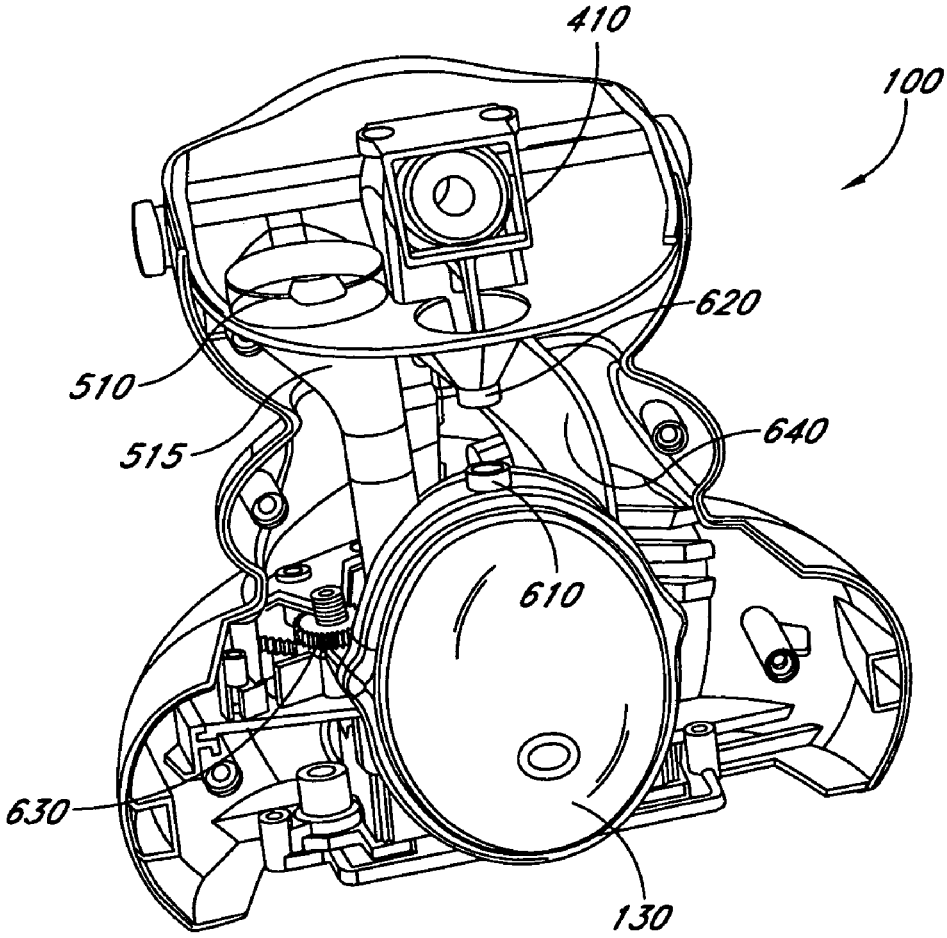
FIG. 6 illustrates a perspective view of the embodiment illustrated in FIG. 1 with a front body portion and upper mouth portion removed.

FIG. 6 illustrates a front view of the embodiment illustrated in FIG. 1 with front body portion 120 removed and movable mouth portion removed showing wipe bar 410 located in a position when movable mouth portion 110 is closed. As illustrated, liquid adding portion 515 has removable lid 510. Overflow return 620 is funnel shaped. Reservoir 130 has return opening 610 and an opening at the lower back portion of reservoir 130 for entry of liquid from adding portion 515. In FIG. 6, the tubing is not shown (see FIG. 8). Gears 630 operate to squeeze a tube every rotation to form a pump.

Figure 7A:
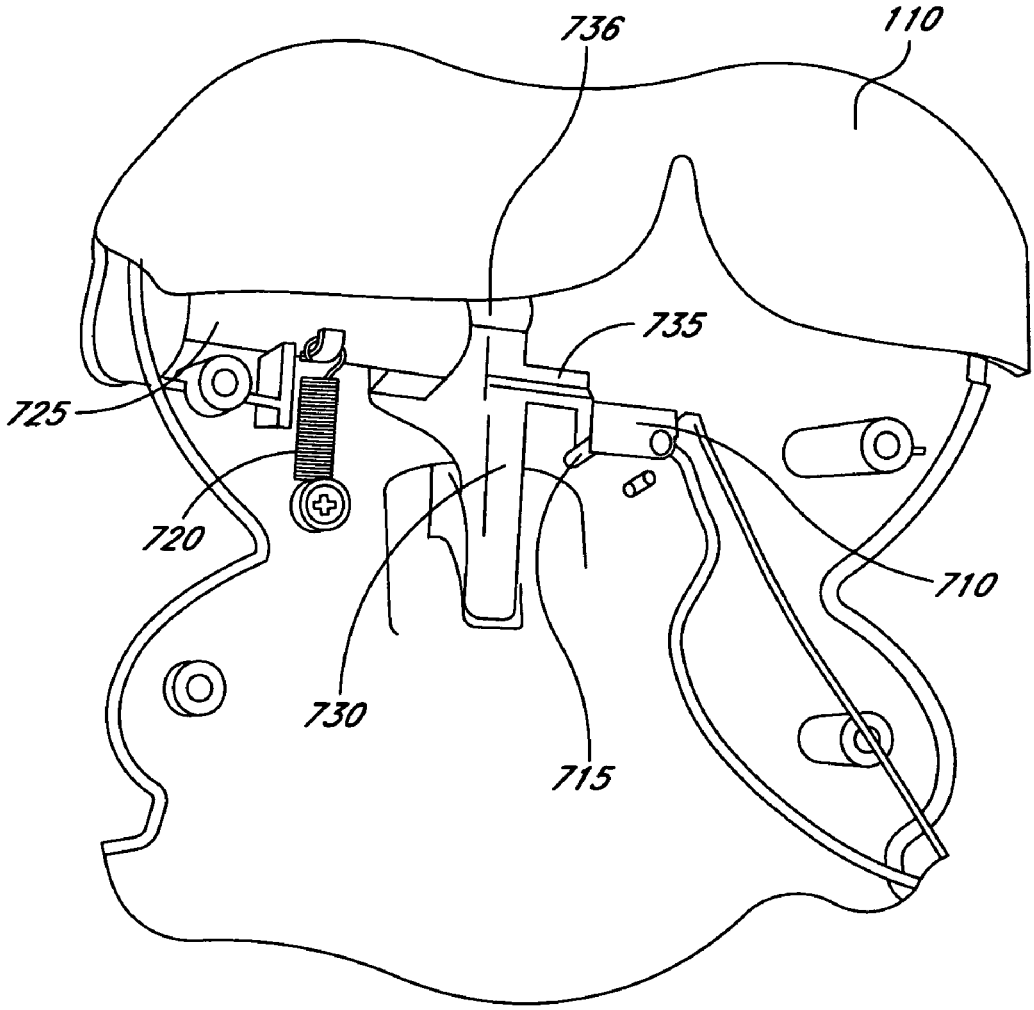
FIG. 7A illustrates an inner view of the main body portion with the motor switch in the "off" position.

FIG. 7A illustrates an internal view of main body portion 150 with trigger 170 in a released state. Trigger 170 has a coupling portion 730 with an extension arm 735. Sleeve 725 couples to movable mouth portion 110. When trigger 170 is pulled coupling portion 730 moves in a downward direction. Sleeve 725 has an extension on its back that comes in contact with rib portion 736. Rib portion 736 moves downward when trigger 170 is pulled. This in turn moves sleeve's 725 extension down which rotates sleeve 725 clockwise, which in turn raises movable mouth portion 110. Switch 710 has lever 715. When trigger 170 is pulled, extension arm 735 moves in a downward direction and pushes lever 715 downward. This closes switch 710 and activates a motor (see FIG. 8).

Spring 720 is connected to a spring holding portion of sleeve 725 at one end, and by a fixing means on the other end connected to the interior of main body portion 150. In one embodiment, the fixing means is a screw. Other embodiments can have alternative fixing means, such as a hook, a plastic securing pin, etc. When the trigger is released, the force from the spring returning to its unstretched state forces movable mouth to close. That is, trigger coupling portion 730 moves upward. Extension arm 735 also moves upward releasing lever 715, which opens switch 710. As illustrated, the upper wire is connected to a power source (e.g., AA batteries) and the lower wire is coupled to motor 816 (see FIG. 8).

Figure 7B:
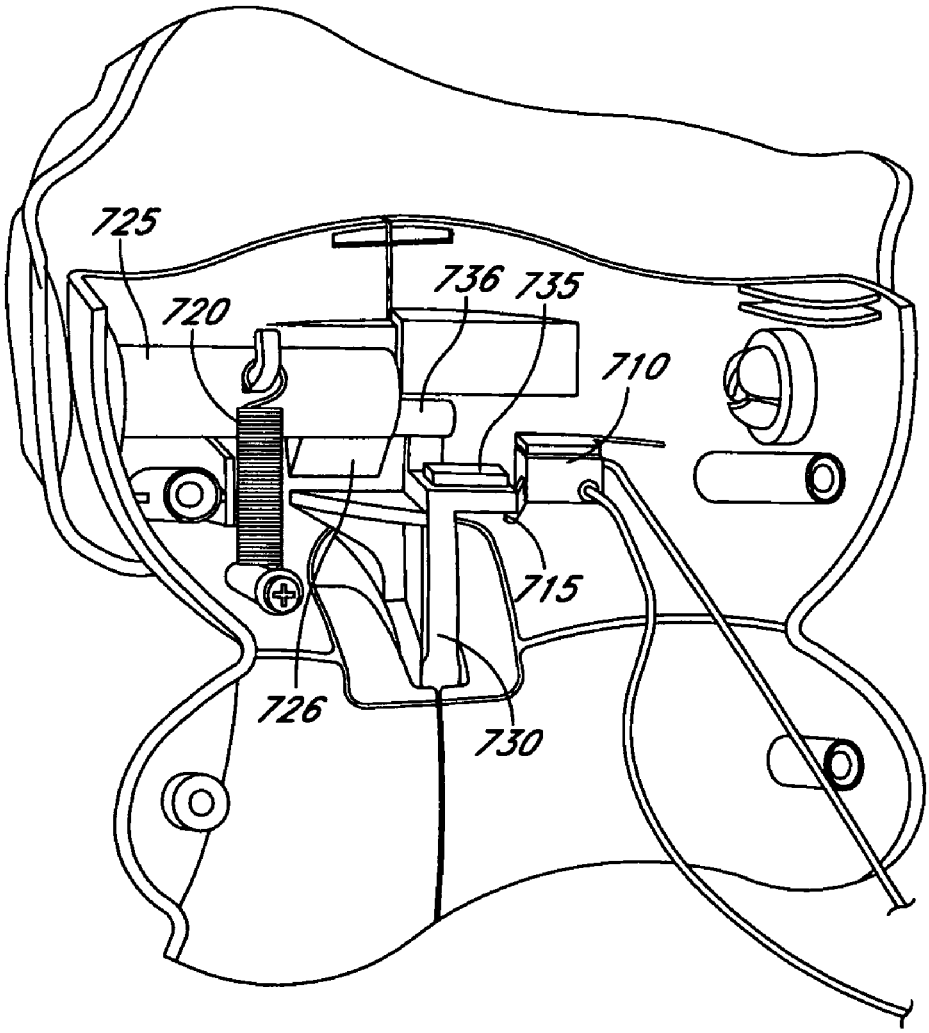
FIG. 7B illustrates an inner view of the main body portion with the motor switch in the "on" position.

FIG. 7B Fig. illustrates an internal view of main body portion 150 with trigger 170 in a "pulled" state. As illustrated, rib portion 736 forced sleeve extension 726 down, which causes sleeve 725 to rotate clockwise. Lever 715 is pushed downward closing switch 710, which activates the motor 816. As illustrated, spring 720 is in a stretched state.

Figure 8:
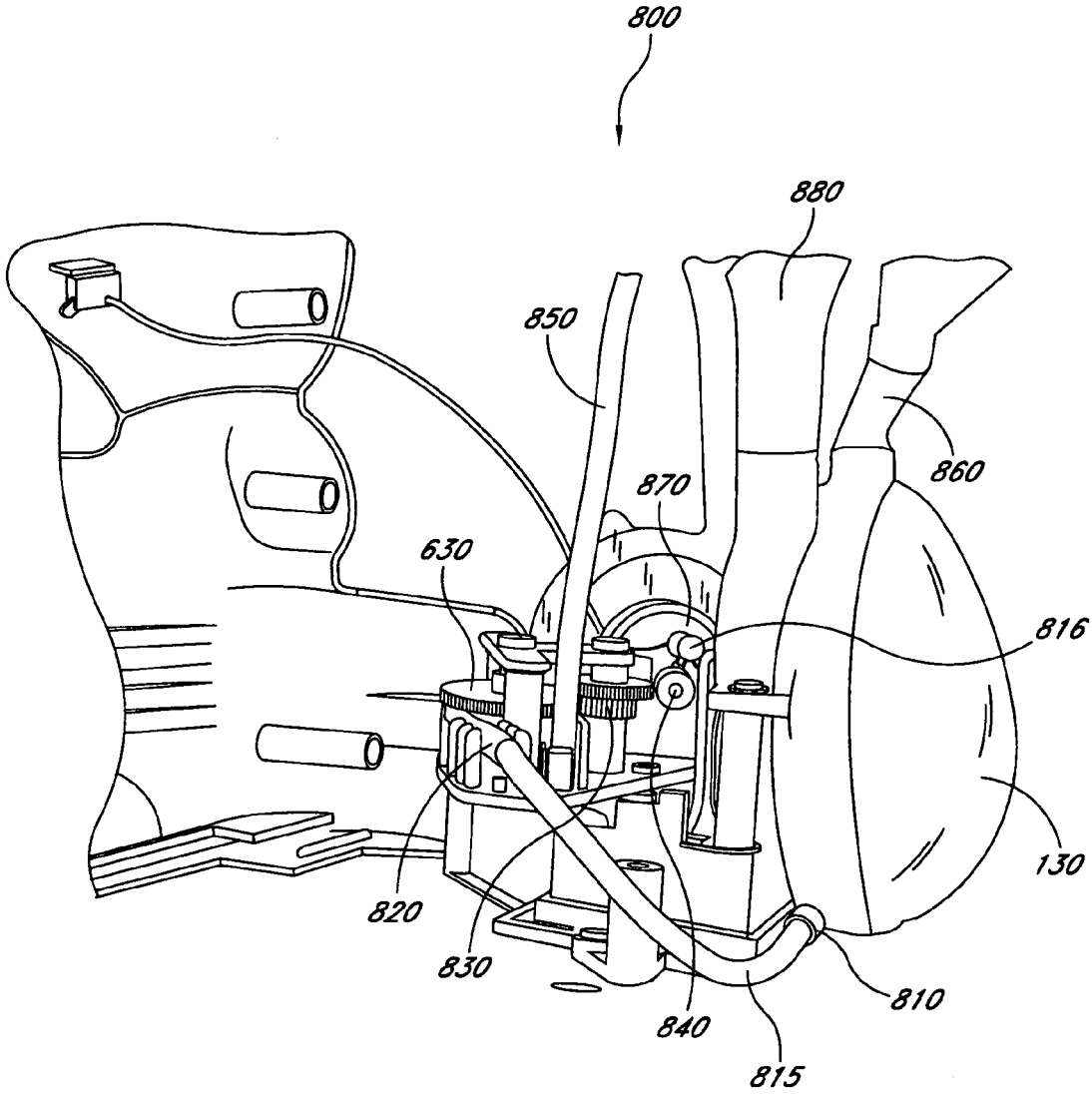
FIG. 8 illustrates the motor, blower and reservoir assembly.

FIG. 8 illustrates motorized bubble making unit 800. As illustrated, bubble making unit 800 includes electric motor 816 with gear 840 and blower 870. A pump is formed from tube 820 and gear 630, which is turned by intermediate gear 830. Gear 630 has a lower portion that includes a squeezing portion on a part of the lower portion. Every rotation of gear 630 causes the squeezing portion to press against tube 820 causing liquid from reservoir 130 to be drawn through tube 815 upward through tube 850. Reservoir 130 has an opening 810 connected with tube 815 that connects to tube 820.

Motor 816 has a rod or spindle connected to a gear 840. Gear 840 turns when motor 816 is activated. Gear 840 turns intermediate gear 830, which turns gear 630. Connecting portion 880 is coupled with liquid adding portion 515. Tube 860 connects reservoir 130 with an upper opening for return of overflow liquid. Motor 816 is a direct current (DC) motor that is powered by batteries. In one embodiment, an AC/DC adapter drives motor 816 for demonstration purposes.

Figure 9:
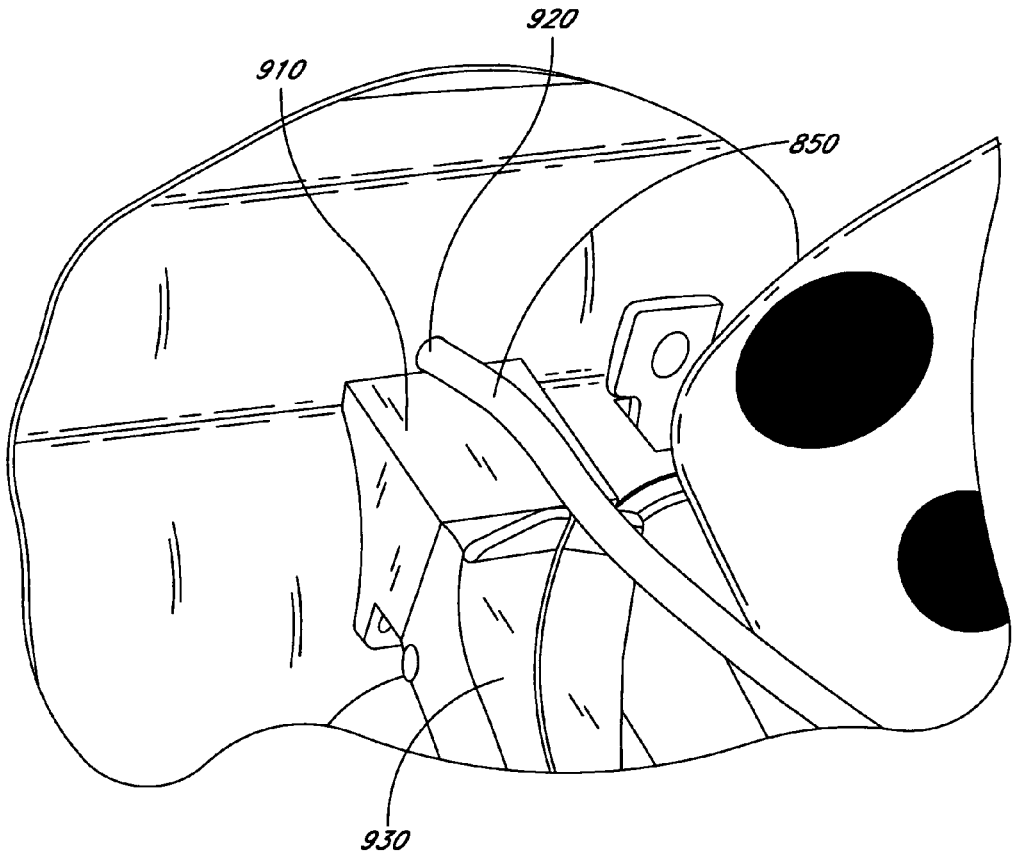
FIG. 9 illustrates a liquid transferring tube connecting to an opening of a mixing chamber.

FIG. 9 illustrates tube 850 that transports liquid to opening 920 into mixing chamber 435. Upper airflow chamber 910 mixes or blows air through air chamber 930 into mixing chamber 435, which blows a bubble liquid through bubble forming ring 420.

Figure 10:
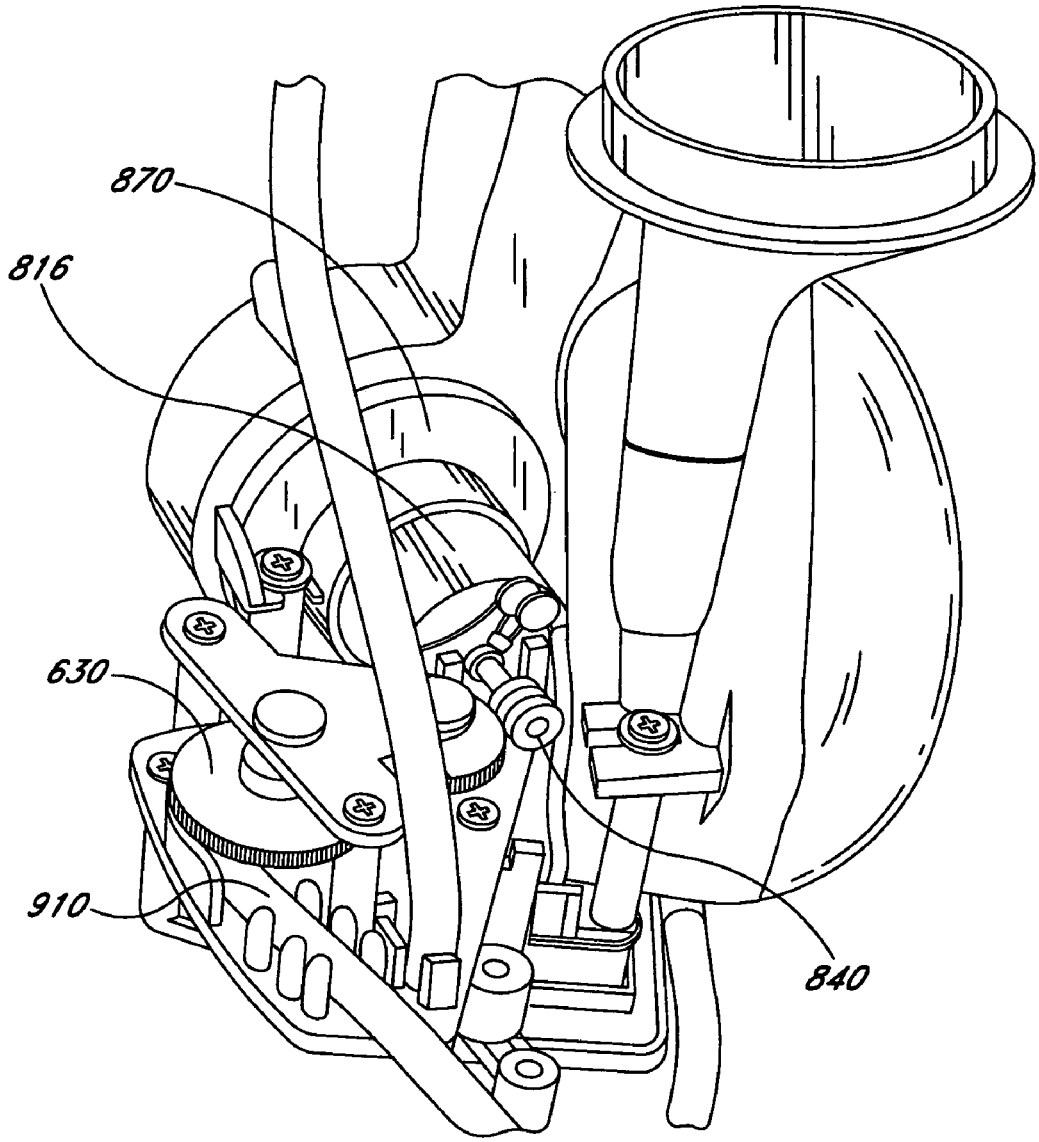
FIG. 10 illustrates a motor, pump and blower of the embodiment of FIG. 1.

FIG. 10 illustrates a view of motor 816, blower 870 and a pump having tube 910 and gear 630. Blower 870 includes an impeller or propeller that spins at a high rate when motor 816 is activated from pulling trigger 170. The impeller or propeller draws air through an opening in the blower housing and forces air upward through air chamber 930.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

What is claimed is:

1. An apparatus comprising:

an animal shaped body comprising a main body portion coupled to a front body portion, the main body portion having a handle with a trigger;

a reservoir fixedly secured at an abdominal region of the animal shaped body, the reservoir including a clear front portion; and a motorized bubble making unit disposed adjacent the main body portion, wherein when the trigger is pulled the motorized bubble making unit is activated to expel a stream of bubbles through a bubble forming ring.

2. The apparatus of claim 1, wherein the motorized bubble making unit includes a motorized pump having a first tube coupled to the reservoir and a second tube coupled to an opening of a mixing chamber.

3. The apparatus of claim 1, wherein the motorized bubble making unit includes a motorized blower to supply forced air through an air chamber to force liquid dispensed through an opening of a mixing chamber and through the bubble forming ring.

4. The apparatus of claim 1, further comprising:

a directional overflow housing including a lower portion that directs overflow liquid into the liquid reservoir.

5. The apparatus of claim 1, wherein the trigger is coupled to a switch, the switch is coupled to a motor and a power source, the motor to activate the blower and the pump when the switch is closed.

6. The apparatus of claim 1, wherein the handle extends from a surface of the main body portion forming a back region of the animal shaped body.

7. The apparatus of claim 6, wherein a movable mouth portion is coupled to the trigger.

8. The apparatus of claim 1, wherein the trigger is coupled to a lever unit, the lever unit is coupled to a movable mouth portion and a first end of a spring, a second end of the spring is coupled to the main body portion, wherein the spring forces the movable mouth portion to a closed position when the trigger is released.

9. The apparatus of claim 1, wherein the reservoir is in a form of a belly.

10. A bubble making toy comprising:

an animal shaped body portion having a handle adjacent a back region of the animal shaped body portion, the handle including a trigger;

a reservoir secured at an abdominal region of the animal shaped body portion, the reservoir including a clear front portion;

a motor coupled to a blower and a pump that are disposed within the body portion;

wherein the trigger activates the blower and pump to force a stream of bubbles through a bubble forming ring.

11. The bubble making toy of claim 10, wherein the pump comprises a first tube coupled to the reservoir and a second tube coupled to an opening of a mixing chamber.

12. The bubble making toy of claim 11, wherein the blower supplies forced air through an air chamber to force the liquid dispensed through the opening through the bubble forming ring.

13. The bubble making toy of claim 11, further comprising:

a directional overflow housing that is coupled to the mixing chamber, the directional overflow housing including a lower portion that directs overflow liquid into the liquid reservoir.

14. The bubble making toy of claim 10, wherein the reservoir is fixedly secured at the abdominal region of the animal shaped body portion.

15. The bubble making toy of claim 14, wherein the motor comprises a rod and the rod spins when the motor is activated.

16. The bubble making toy of claim 15, the trigger is coupled to a lever unit, the lever unit is coupled to a movable mouth portion and a first end of a spring, a second end of the spring is coupled to the main body portion, wherein the spring forces the movable mouth portion to a closed position when the trigger is released.

17. The bubble making toy of claim 10, wherein the reservoir is in a form of a belly.

18. A bubble toy comprising:

an animal shaped body portion having a handle with a trigger;

secured at an abdominal region of the animal shaped body portion, the reservoir including a clear front portion; and a motor coupled to a blower and a pump, the motor, the pump, and the blower are disposed within the body portion;

wherein the trigger activates the motor to force a stream of bubbles formed through a bubble forming ring.

19. The bubble toy of claim 18, wherein the pump comprises a first tube coupled to the reservoir and a second tube coupled to an opening of a mixing chamber, wherein the opening is at a height below the bubble forming ring.

20. The bubble joy of claim 18, wherein the reservoir is fixedly secured at the abdominal region of the animal shaped body portion.

* * * * *

UNITED STATES PATENT AND TRADEMARK OFFICE

CERTIFICATE OF CORRECTION

PATENT NO. : 7,470,165 B2
APPLICATION NO. : 11/473942
DATED : December 30, 2008
INVENTOR(S) : Ivanic It is certified that error appears in the above-identified patent and that said Letters Patent is hereby corrected as shown below:

In Claim 20, line 1, please delete “joy” and insert -- toy --.

Signed and Sealed this

Twenty-eighth Day of April, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,470,165 B2
APPLICATION NO. : 11/473942
DATED : December 30, 2008
INVENTOR(S) : Ivanic It is certified that error appears in the above-identified patent and that said Letters Patent is hereby corrected as shown below:

Column 6, In Claim 20, line 24, please delete "joy" and insert -- toy --.

This certificate supersedes the Certificate of Correction issued April 28, 2009.

Signed and Sealed this

Nineteenth Day of May, 2009

John Doll

JOHN DOLL
*Acting Director of the United States Patent and Trademark Office*